US012552624B2

(12) United States Patent
Kohara

(10) Patent No.: US 12,552,624 B2
(45) Date of Patent: Feb. 17, 2026

(54) SHEET CONVEYING DEVICE AND IMAGE FORMING APPARATUS

(71) Applicant: Satoshi Kohara, Tokyo (JP)

(72) Inventor: Satoshi Kohara, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 119 days.

(21) Appl. No.: 18/503,582

(22) Filed: Nov. 7, 2023

(65) Prior Publication Data

US 2024/0174466 A1 May 30, 2024

(30) Foreign Application Priority Data

Nov. 29, 2022 (JP) ..... 2022-190704

(51) Int. Cl.

| | |
|---|---|
| ***B65H 3/68*** | (2006.01) |
| ***B65H 3/12*** | (2006.01) |
| ***B65H 3/14*** | (2006.01) |
| ***B65H 3/48*** | (2006.01) |
| ***B65H 3/66*** | (2006.01) |

(52) U.S. Cl.

CPC ..... *B65H 3/68* (2013.01); *B65H 3/128* (2013.01); *B65H 3/14* (2013.01); *B65H 3/48* (2013.01); *B65H 3/66* (2013.01); *B65H 2404/531* (2013.01); *B65H 2404/61* (2013.01)

(58) Field of Classification Search

CPC . B65H 1/04; B65H 3/128; B65H 3/14; B65H 3/48; B65H 3/66; B65H 3/68; B65H 2404/521; B65H 2404/5211; B65H 2404/5213; B65H 2404/52131; B65H 2404/5214; B65H 2404/531; B65H 2404/61

See application file for complete search history.

(56) References Cited

U.S. PATENT DOCUMENTS

| | | | | |
|---|---|---|---|---|
| 5,876,030 | A * | 3/1999 | Dobbertin | B65H 3/128 271/169 |
| 2013/0049286 | A1* | 2/2013 | Yamazaki | B65H 3/128 271/11 |
| 2018/0297802 | A1* | 10/2018 | Ishida | B65H 29/52 |
| 2020/0122491 | A1* | 4/2020 | Ogawa | B41J 11/0045 |
| 2022/0081235 | A1* | 3/2022 | Maeda | B65H 1/14 |
| 2022/0324670 | A1 | 10/2022 | Yamamoto et al. | |
| 2023/0234802 | A1 | 7/2023 | Kohara | |

FOREIGN PATENT DOCUMENTS

| | | | |
|---|---|---|---|
| JP | H07-309470 | A | 11/1995 |
| JP | 2004-155509 | A | 6/2004 |
| JP | 2018-002382 | A | 1/2018 |
| JP | 2018-122971 | A | 8/2018 |
| JP | 2019-131383 | A | 8/2019 |
| JP | 2020-066532 | A | 4/2020 |

* cited by examiner

*Primary Examiner* — Prasad V Gokhale

(74) *Attorney, Agent, or Firm* — Harness, Dickey & Pierce, P.L.C.

(57) ABSTRACT

A sheet conveying device includes a sheet stacker, an air blower, and a guide. The sheet stacker stacks a plurality of sheets. The air blower blows air onto the plurality of sheets. The guide faces an uppermost sheet of the plurality of sheets on the sheet stacker and contacts the uppermost sheet at a plurality of positions of the guide spaced apart from each other in a sheet conveyance direction.

8 Claims, 7 Drawing Sheets

SHEET CONVEYING DEVICE AND IMAGE FORMING APPARATUS

CROSS-REFERENCE TO RELATED APPLICATIONS

This patent application is based on and claims priority pursuant to 35 U.S.C. § 119(a) to Japanese Patent Application No. 2022-190704, filed on Nov. 29, 2022, in the Japan Patent Office, the entire disclosure of which is hereby incorporated by reference herein.

BACKGROUND

Technical Field

Embodiments of the present disclosure relate to a sheet conveying device and an image forming apparatus.

Related Art

A sheet conveying device is known that includes a sheet stacker to stack sheets, an air blower to blow air to the sheets, and a guide facing an uppermost sheet of the sheets on the sheet stacker.

The sheet conveying device blows air to multiple sheets in the sheet stacker by an air blower to separate an uppermost sheet from the multiple sheets and convey the separated uppermost sheet. Such a sheet conveying device includes a linear-shaped guide which contacts a surface of the uppermost sheet separated from the multiple sheets over a predetermined area from upstream to downstream in a sheet conveyance direction to guide the uppermost sheet. The multiple guides are arranged at intervals in a direction perpendicular to the sheet conveyance direction.

SUMMARY

In an embodiment of the present disclosure, a sheet conveying device includes a sheet stacker, an air blower, and a guide. The sheet stacker stacks a plurality of sheets. The air blower blows air onto the plurality of sheets. The guide faces an uppermost sheet of the plurality of sheets on the sheet stacker and contacts the uppermost sheet at a plurality of positions of the guide spaced apart from each other in a sheet conveyance direction.

In another embodiment of the present disclosure, an image forming apparatus includes the sheet conveying device and an image forming device. The image forming device forms an image on a sheet. The sheet conveying device and the image forming device are integrated as a single unit or are separated units.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
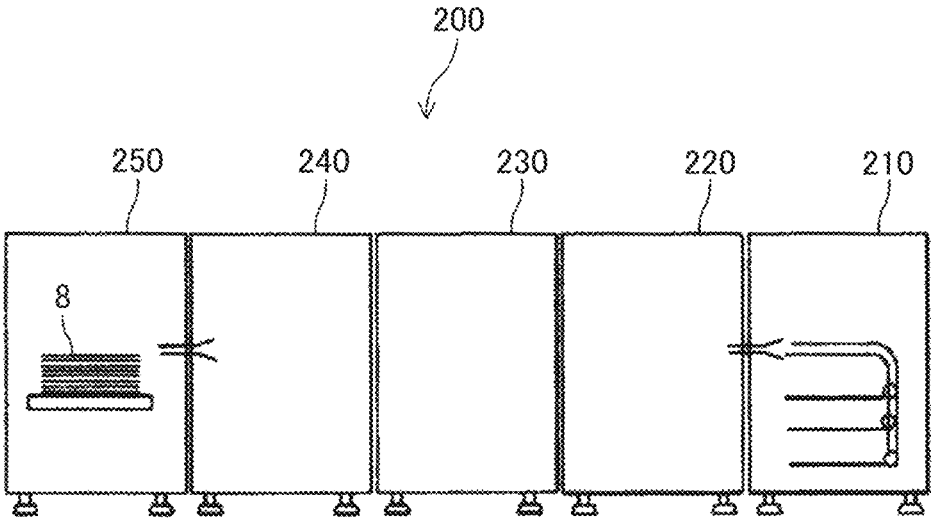
FIG. 1 is a diagram illustrating a schematic configuration of an entire image forming system according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Referring now to the drawings, embodiments of the present disclosure are described below. As used herein, the singular forms "a," "an," and "the" are intended to include the plural forms as well, unless the context clearly indicates otherwise.

Embodiments of the present disclosure applied to a sheet conveying device, which is a sheet stacker including a feeder in an image forming system, are described below with reference to the drawings. FIG. 1 is a diagram illustrating a schematic configuration of an entire image forming system 200 according to an embodiment of the present disclosure. The image forming system 200 includes a sheet feeder 210, a pretreatment liquid application device 220, an inkjet printer 230, a drying device 240, and a sheet ejector 250.

The sheet feeder 210 supplies sheets 8 as recording media such as cut sheets to the pretreatment liquid application device 220 disposed downstream in a conveyance path of the sheets 8. The pretreatment liquid application device 220 applies a pretreatment liquid, which prevents bleeding and bleed-through of inkjet ink, to a sheet 8. The pretreatment liquid application device 220 includes a reverse path. When duplex printing is performed, after the pretreatment liquid has been applied to the front side of the sheet 8, the sheet 8 is reversed and the pretreatment liquid can also be applied to the back side of the sheet 8.

The inkjet printer 230 discharges ink droplets onto the front side of the sheet 8 to which the pretreatment liquid has been applied by the pretreatment liquid application device 220 to form a desired image. The drying device 240 includes a dryer and dries the image, which has been formed by the inkjet printer 230, on the front side of the sheet 8. When printing is performed on the front and back sides of the sheet 8, the sheet 8 is reversed in a path from the drying device 240 back to the inkjet printer 230. Subsequently, the inkjet printer 230 discharges ink droplets onto the front side, which is the back side of the sheet 8 before the sheet 8 is reversed, of the sheet 8 whose front and back sides have been reversed to form a desired image. The drying device 240 dries the image on the front side, which is the back side of the sheet 8 before the sheet 8 is reversed, of the sheet 8. Subsequently, the sheet 8 is ejected to the sheet ejector 250.

Figure 2A:
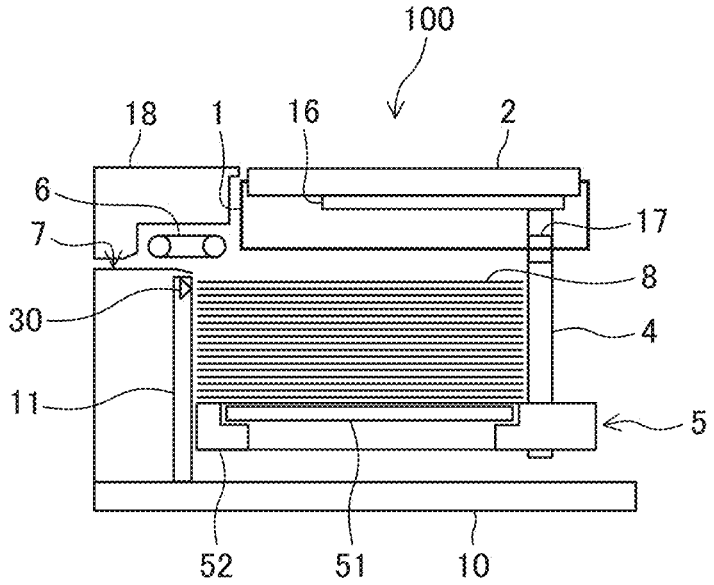
FIGS. 2A and 2B are diagrams each illustrating a schematic configuration of a sheet tray provided for a sheet feeder, according to an embodiment of the present disclosure.
Figure 2B:
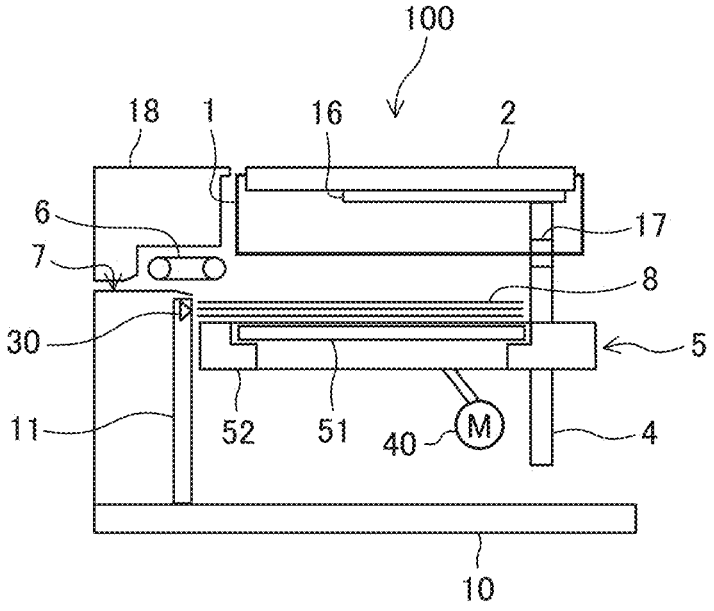

FIGS. 2A and 2B are diagrams each illustrating a schematic configuration of the sheet tray 100 provided for the sheet feeder 210, according to an embodiment of the present disclosure. FIGS. 2A and 2B are front views of the sheet tray 100 in which a sheet 8 is fed from right to left in FIGS. 2A and 2B. FIG. 2A is a diagram illustrating the sheet tray 100 in which the amount of the bundle of sheets 8 is relatively large. FIG. 2B is a diagram illustrating the sheet tray 100 in which the amount of the bundle of sheets 8 is reduced. The sheet tray 100 includes a lift table 5, movable in a vertical direction by a motor 40, onto which sheets 8 are stacked. The lift table 5 includes a plurality of bottom-surface supports 51 for supporting the bottom surface of the sheet 8 and a tip-end bottom support 52 for supporting the bottom surface of tip ends of the sheets 8. The lift table 5 is moved in the vertical direction by the motor 40 and is controlled by control of the motor 40 based on a signal from a sensor such that the upper surface of the sheet 8 is positioned at a predetermined position. By this control, the upper surface of the stacked sheets 8 is maintained at a constant height position.

The sheets 8 are stacked such that the ends of the sheets 8 downstream in the longitudinal direction of the sheets 8 contact a front-side plate 11. The ends of the sheets 8 upstream in the longitudinal direction are pressed against an end fence 4 to be set. The end fence 4 is coupled to a guide rail 16 via a rotary hinge 17, and the guide rail 16 is fixed to a guide frame 2. The end fence 4 is movable in the longitudinal direction of the sheets 8 and can be fixed with the ends of the sheets 8 upstream in the sheet conveyance direction pressed against the end fence 4. The lift table 5 includes an end-fence escape portion 53 through which the end fence 4 can pass (see FIG. 4). The moving amount of the end fence 4 corresponds to the size of the sheets 8 stacked on the sheet tray 100. Thus, a moving range of the end fence 4 is set.

When the printing operation is started, the air is blown out from an air nozzle 30 attached to the front-side plate 11 to float sheets 8. Accordingly, the ends of the sheets 8 upstream in the conveyance direction are blown up to the vicinity of a pickup belt 6 as a suction conveyor. Multiple holes are formed in the pickup belt 6, and air is sucked into the multiple holes by a fan. An uppermost sheet among the sheets 8 floated by the air blown out from the air nozzle 30 is sucked by the pickup belt 6 and is ejected toward the guide plate 7 with the movement of the pickup belt 6. The pickup belt 6 is held by an upper housing 18.

When the sheets 8 that are floated by the air from downstream to upstream in the sheet conveyance direction is excessively floated, the sheet 8 may be folded or wrinkled. Multiple linear upper-surface restricting members 1 that extend in the sheet conveyance direction are attached to the guide frame 2 as guides to prevent the sheets 8 from being folded and wrinkled. Specifically, the multiple upper-surface restricting members 1 are attached to the guide frame 2 at positions different in a sheet width direction perpendicular to the sheet conveyance direction. The upper-surface restricting member 1 illustrated in FIGS. 2A, 2B, 3A, 3B, and 4 only illustrates a basic structure of the upper-surface restricting member 1 in which the upper-surface restricting member 1 is formed of a linear member. The specific shape of the upper-surface restricting member 1 according to the present embodiment is described in detail below.

The air is blown from the air nozzle 30 to upper ends of the sheet bundle of the sheets 8 stacked on the lift table 5. When a tip end of an uppermost sheet 8 floated is attracted and conveyed by the pickup belt 6, the upper surface of the floated uppermost sheet 8 contacts the upper-surface restricting member 1. Accordingly, the posture of the uppermost sheet 8 is maintained.

Figure 3A:
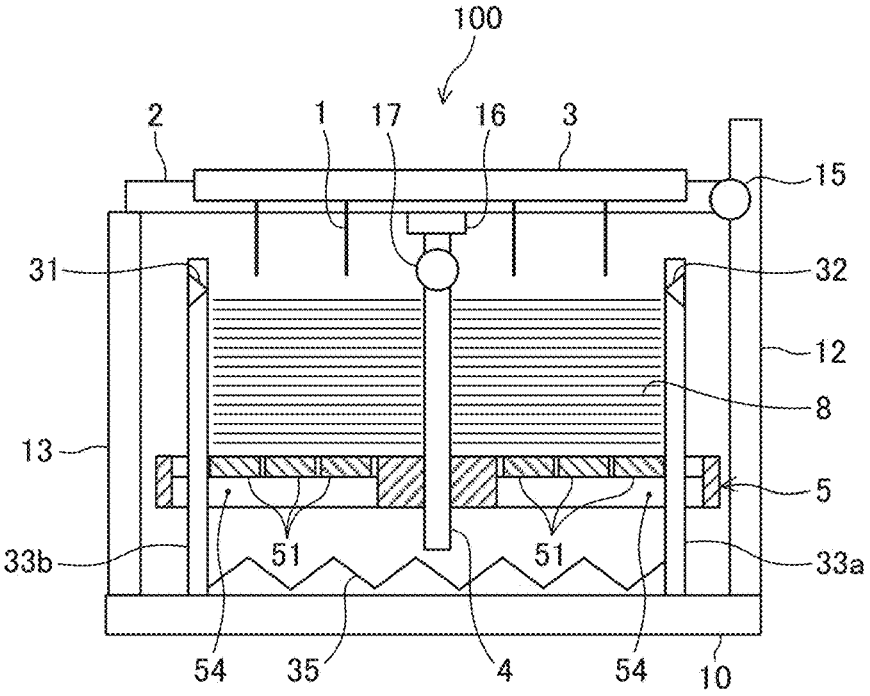
FIGS. 3A and 3B are diagrams each illustrating the right side of the sheet tray of FIGS. 2A and 2B.
Figure 3B:
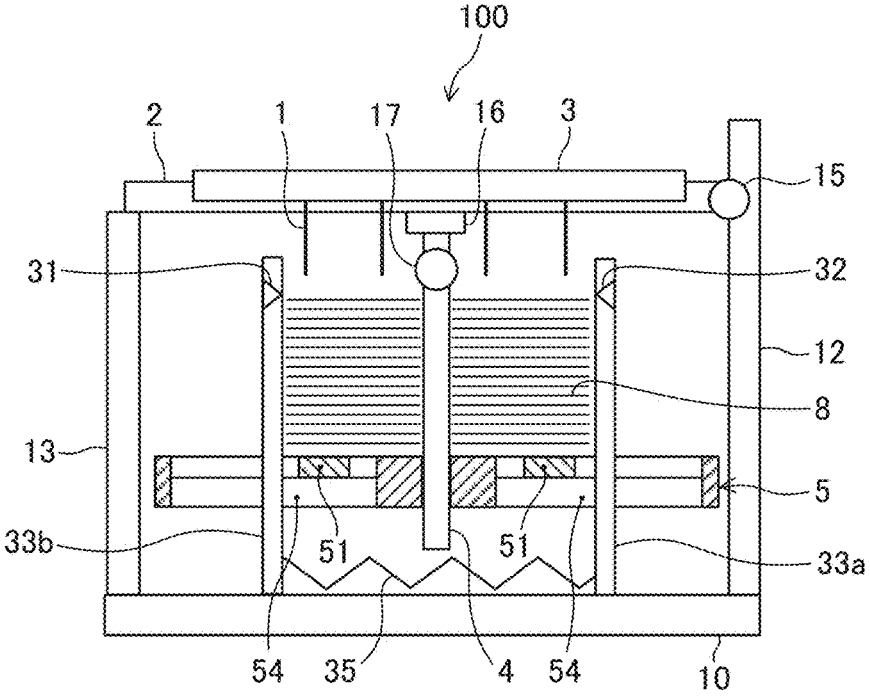
Figure 4:
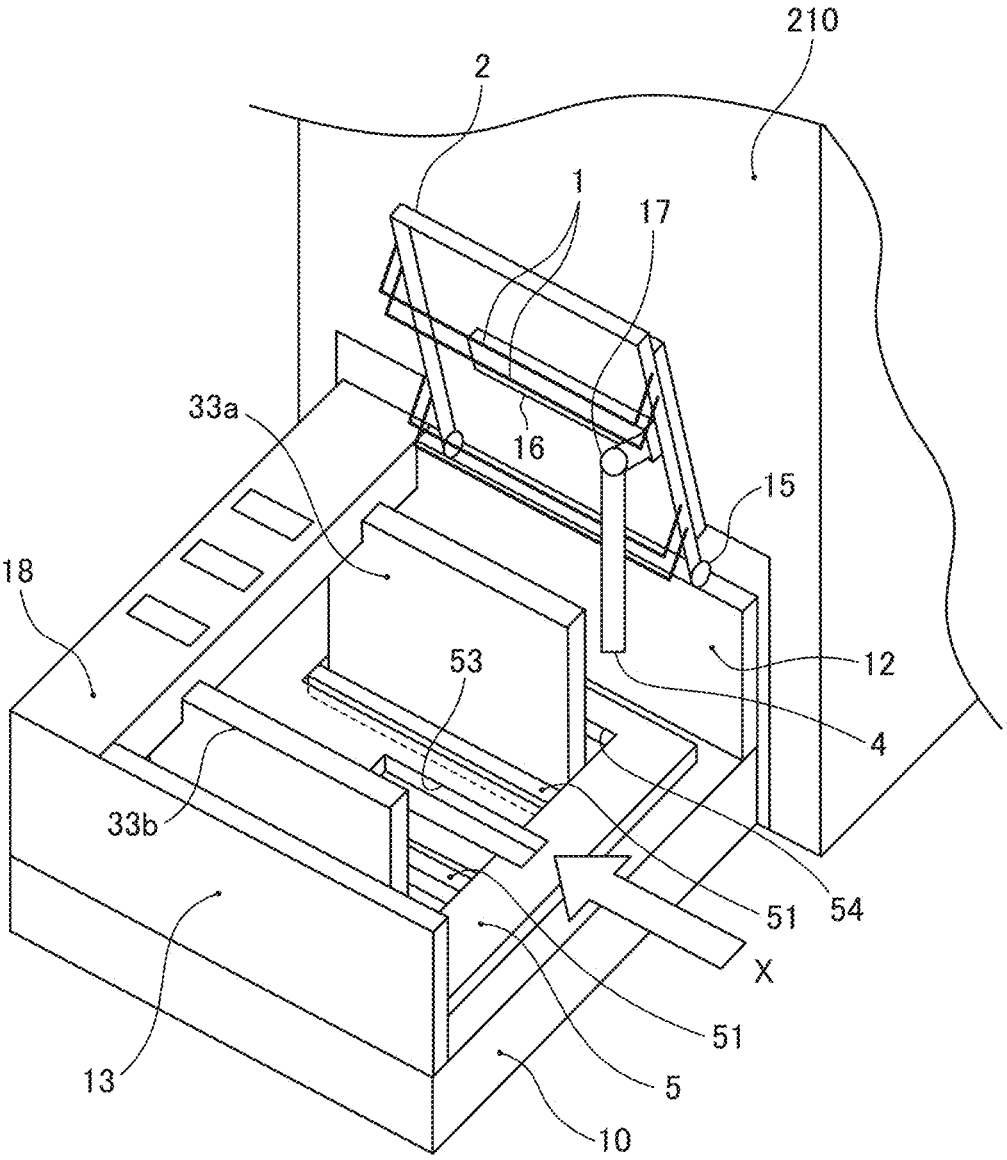
FIG. 4 is a perspective view of the sheet tray of FIGS. 3A and 3B, in which the sheet tray is pulled out from the body of the sheet feeder.

FIGS. 3A and 3B are diagrams each illustrating the right side of the sheet tray 100, according to an embodiment of the present disclosure. The left-right direction in FIGS. 3A and 3B is the front-rear direction of the sheet tray 100, in other words, the sheet width direction. FIG. 3A is a diagram illustrating the sheet tray 100 in which a bundle of sheets 8 having a large-width size is set. FIG. 3B is a diagram illustrating the sheet tray 100 in which a bundle of sheets 8 having a small-width size is set. FIG. 4 is a perspective view of the sheet tray 100 in which the sheet tray 100 is pulled out from the body of the sheet feeder 210, according to an embodiment of the present disclosure. A direction indicated by hollow arrow X in FIG. 4 indicates a direction in which the sheet bundle of the sheets 8 is set.

In FIGS. 3A and 3B, the sheet tray 100 has a structure in which the lift table 5 and the end fence 4 illustrated in FIGS. 2A and 2B are disposed in a box-shaped structure formed by a front-side plate 13 and a rear-side plate 12 attached to a bottom plate 10. The guide frame 2 is attached to the rear-side plate 12 via a rotation hinge 15 to rotate about the rotation hinge 15 (see FIG. 4). The multiple upper-surface restricting members 1 are attached to the guide frame 2 and fixed at positions in accordance with the width of sheets 8 stacked on the lift table 5.

Side fences 33*a* and 33*b* are attached to the right and left sides, respectively, of the lift table 5, and the positions of the side fences 33*a* and 33*b* are moved in accordance with the width of the set sheets 8. The side fences 33*a* and 33*b* are moved in conjunction with each other with a coupler 35 disposed between the side fences 33*a* and 33*b*. The lift table 5 includes side-fence escape portions 54 through which the side fences 33*a* and 33*b* can pass (see FIG. 4).

The multiple bottom-surface supports 51 placed on the lift table 5 are removably attached in accordance with the width of sheets 8 on the lift table 5 and slidable in the width direction of the sheets 8. As illustrated in FIG. 3A, when a bundle of large-size sheets 8 is set, three bottom-surface supports 51 are attached to the respective side-fence escape portions 54. As illustrated in FIG. 3B, when a bundle of small-size sheets 8 is set, one bottom-surface support 51 is attached to corresponding one of the side-fence escape portions 54.

Multiple air nozzles 31 and 32 are disposed on the side fences 33*b* and 33*a*, respectively, and the air is blown from the air nozzles 31 and 32 when the printing operation is started. Accordingly, when the printing operation is performed, several upper sheets 8 of the bundle of the sheets 8 are floated as a whole, and the floated sheets 8 are restricted by the upper-surface restricting members 1 and held at a constant height.

Figure 5A:
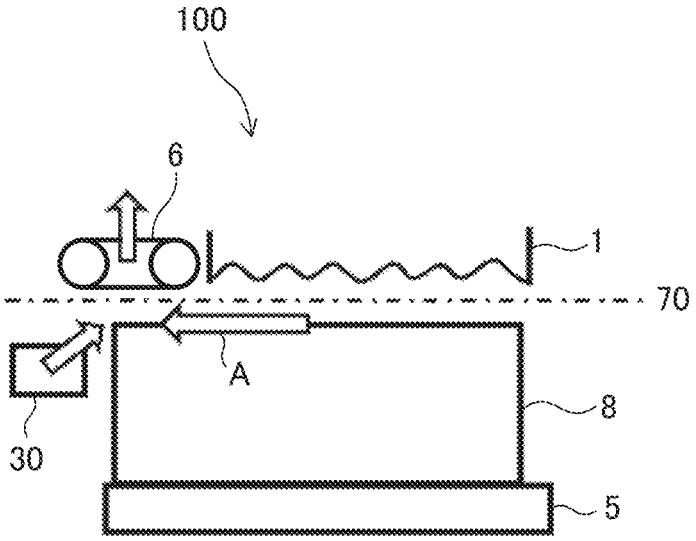
FIG. 5A is a diagram illustrating the shape of an upper-surface restricting member provided for a sheet feeder viewed from the front side of the sheet feeder, according to an embodiment of the present disclosure.
Figure 5B:
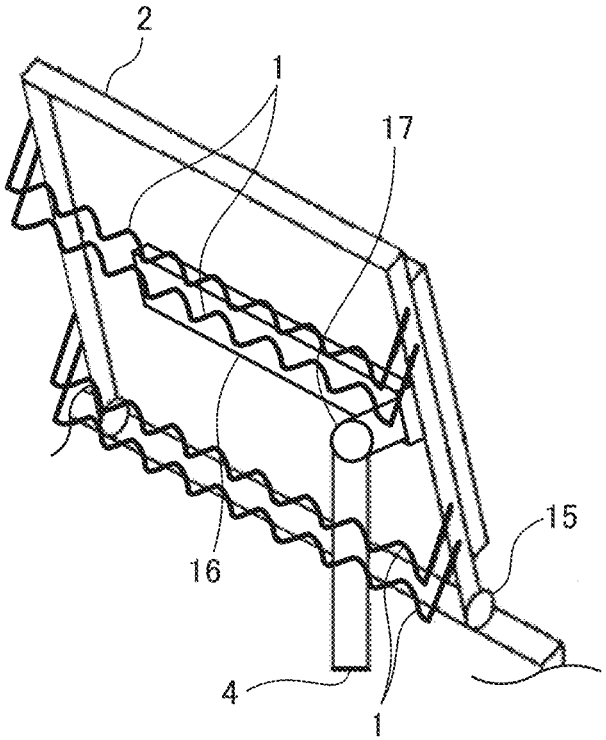
FIG. 5B is a perspective view of the upper-surface restricting members of FIG. 5A, in which a guide frame to which the upper-surface restricting members are attached is opened.

FIGS. 5A and 5B are diagrams each illustrating the shape of the upper-surface restricting member 1 according to an embodiment of the present disclosure. FIG. 5A is a diagram illustrating the upper-surface restricting member 1, viewed from the front side of the sheet feeder 100. FIG. 5B is a perspective view of the upper-surface restricting members 1 in which the guide frame 2 is opened. The upper-surface restricting member 1 of the present embodiment has a shape such that the upper-surface restricting member 1 contacts an uppermost sheet 8 floating from the sheet bundle of the sheets 8 at multiple positions spaced apart from each other in the sheet conveyance direction indicated by a direction indicated by a hollow arrow Ain FIG. 5A. The upper-surface restricting member 1 illustrated in FIGS. 5A and 5B is a linear member having a wave shape such that the distance between the upper-surface restricting member 1 and the lift table 5 as a sheet stacker varies in the sheet conveyance direction.

In the example illustrated in FIGS. 5A and 5B, the upper-surface restricting member 1 has a wave shape over the entire region from upstream to downstream in the sheet conveyance direction indicated by the hollow arrow A, to point contact a floating sheet 8. Accordingly, an area in which the upper-surface restricting member 1 contacts the floated sheet 8 can be reduced. As a result, the contact resistance of the upper-surface restricting member 1 with the sheet 8 can be reduced, and the conveyance load of the sheet 8 can be reduced as compared with a case in which the upper-surface restricting member 1 continuously contacts the floated sheet 8 linearly. As the linear member for the upper-surface restricting member 1, a round bar-shaped member having a circular cross-sectional shape is preferable. However, a linear member having other cross-sectional shapes can also be employed for the upper-surface restricting member 1. As long as the upper-surface restricting member 1 has a shape such that the upper-surface restricting member 1 contacts the uppermost sheet 8 floating from the sheet bundle of the sheets 8 at multiple positions spaced apart from each other in the sheet conveyance direction, the upper-surface restricting member 1 may not have a wave shape. In addition, the upper-surface restricting member 1 may be formed of a member other than a linear member.

As illustrated in FIG. 5A, the upper-surface restricting member 1 is preferably disposed such that positions at which the upper-surface restricting member 1 contacts the upper surface of the floated sheet 8 are at substantially the same height as a sheet conveyance surface 70 at which the floated sheet 8 is conveyed by the pickup belt 6 or at a height higher than the sheet conveyance surface 70. Such a configuration as described above allows the posture of the floated sheet 8 to be maintained while the floated sheet 8 is attracted and conveyed by the pickup belt 6.

Figure 6A:
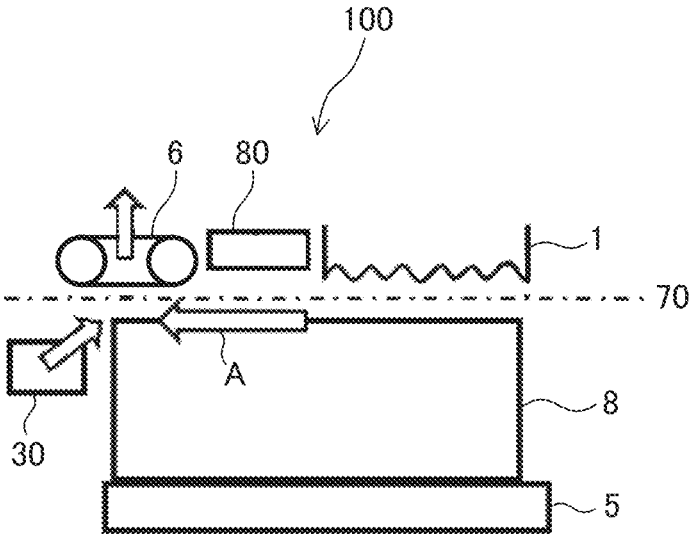
FIG. 6A is a diagram illustrating a sheet tray, viewed from the front side of the sheet tray, according to a modification of the present disclosure.
Figure 6B:
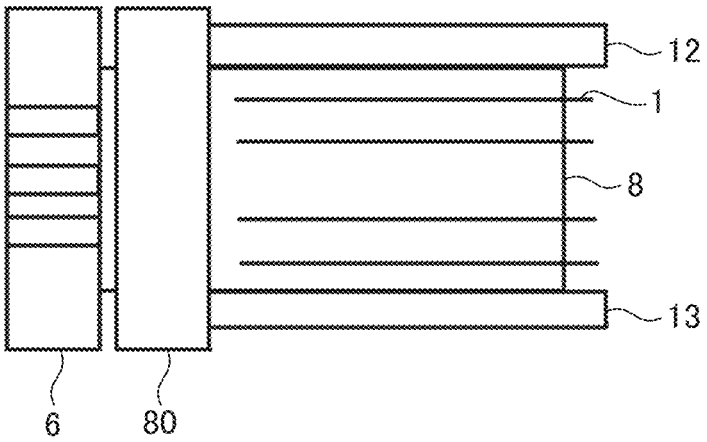
FIG. 6B is a diagram illustrating the sheet tray of FIG. 6A, viewed from above.

FIGS. 6A and 6B are diagrams each illustrating the sheet tray 100 according to a modification of the above embodiments of the present disclosure. FIG. 6A is a diagram illustrating the sheet tray 100, viewed from the front side of the sheet tray 100. FIG. 6B is a diagram illustrating the sheet tray 100, viewed from above. In the present modification, a surface guide 80 having a surface facing an uppermost sheet 8 is disposed between the suction conveyor 6 and the upper-surface restricting members 1 in the sheet conveyance direction. The surface of the surface guide 80 facing an uppermost sheet 8 is wide enough to perform the functions described below. Preferably, the surface of the surface guide 80 is equal to or greater than 60 mm in the sheet conveyance direction and equal to or greater than 80 mm in the width direction orthogonal to the sheet 8. For example, when the maximum length of the sheets 8 stacked in the sheet tray 100 is 585 mm, the length of the surface guide 80 is equal to or greater than 60 mm in the sheet conveyance direction and 670 mm in the width direction perpendicular to the sheets 8.

The surface guide 80 surface contacts the upper surface of the sheet 8 to restrict the sheet 8 from moving and prevents floating air from escaping in the vicinity of an area upstream from the pickup belt 6. The relative positions of the surface guide 80 and the upper-surface restricting member 1 are determined such that the surface guide 80 restricts the sheet 8 at a position higher than the upper-surface restricting member 1. Accordingly, the upper surface of the uppermost sheet 8 floated while being restricted by the upper-surface restricting member 1 is prevented from contacting the surface guide 80 at least after the pickup belt 6 starts attracting and conveying the sheet 8. Such a configuration as described above can minimize the contact resistance between the upper surface of the floated uppermost sheet 8 and the surface guide 80 or the upper-surface restricting member 1.

Figure 7:
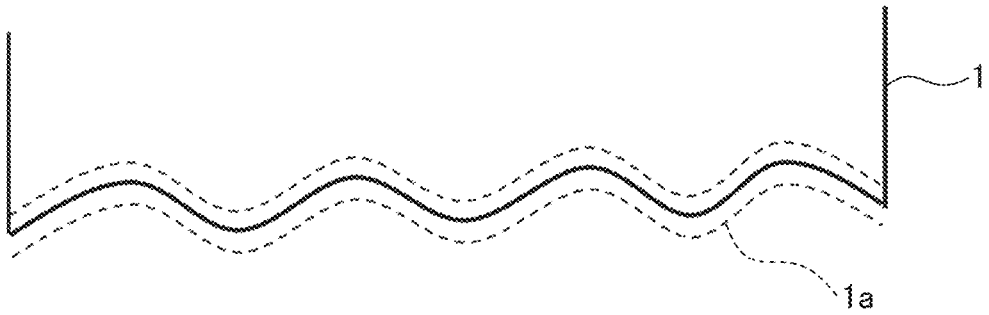
FIG. 7 is a diagram illustrating an upper-surface restricting member according to a modification of the present disclosure.

FIG. 7 is a diagram illustrating the upper-surface restricting member 1 according to a modification of the above embodiments of the present disclosure. The upper-surface restricting member 1 according to the present modification includes a surface layer at least on a surface of the base of the upper-surface restricting member 1, facing the sheet 8. The surface layer has a friction coefficient with the sheet 8, smaller than the friction coefficient of the base. For example, the surface layer has a sliding property by surface treatment such as coating of Teflon (registered trademark) onto the surface layer.

The above-described embodiments are illustrative and do not limit the embodiments of the present disclosure. Thus, numerous additional modifications and variations are possible in light of the above teachings. For example, elements and/or features of different illustrative embodiments may be combined with each other and/or substituted for each other within the scope of the present disclosure. For example, in the image forming system 200 that serves as the image forming apparatus in FIG. 1, the sheet feeder 210 that serves as a sheet conveying device and the inkjet printer 230 that serves as an image forming device are separate components. However, the embodiments of the present disclosure can also be applied to an image forming apparatus in which a sheet conveying device and an image forming device are integrated with the image forming apparatus.

The effects described in the embodiments of the present disclosure are listed as examples of most preferable effects derived from the present disclosure, and therefore are not limited to the effects described above.

The above-described configurations are some examples, and the following aspects of the present disclosure have, for example, advantageous effects described below.

First Aspect

A sheet conveying device includes a sheet stacker such as the lift table 5, an air blower such as the air nozzle 30, and a guide such as the upper-surface restricting member 1. The sheet stacker stacks sheets such as the sheets 8. The air blower blows air to the sheets. The guide faces an uppermost sheet of the sheets stacked on the sheet stacker and contacts the uppermost sheet at multiple positions spaced from each other in a sheet conveyance direction. Such a configuration as described above can reduce the contact resistance with the sheet and reduce the conveyance load of the sheet as compared with a case in which a guide has a shape such that the guide continuously contacts the sheet in the sheet conveyance direction.

Second Aspect

In the sheet conveying device according to the first aspect, the guide is a linear member having a wave shape in which a distance between the guide and the sheet stacker varies in the sheet conveyance direction. Such a simple configuration in which the linear member has a wave shape as described above can reduce the conveyance load of the sheet.

Third Aspect

In the sheet conveying device according to the second aspect, multiple guides including the guide are arranged at intervals in a direction perpendicular to the sheet conveyance direction. Such a configuration as described above allows the sheet conveying device to favorably restrict the upper surface of the sheet while reducing the conveyance load of the sheet.

Fourth Aspect

The sheet conveying device according to the first aspect further includes a suction conveyor such as the pickup belt 6 to attract and convey the uppermost sheet floated by air blown from the air blower. The plurality of positions at which the guide contacts the uppermost sheet are not lower than a height at which the sheet is attracted and conveyed by the suction conveyor. Such a configuration as described above allows the posture of the floated sheet to be maintained while the floated sheet is attracted and conveyed by the pickup belt.

Fifth Aspect

The sheet conveying device according to the first aspect further includes a suction conveyor such as the pickup belt 6 to attract and convey the uppermost sheet floated by air blown from the air blower and a surface guide having a surface facing the uppermost sheet. The surface guide is disposed between the suction conveyor and the guide in the sheet conveyance direction. Such a configuration as described above can prevent floating air from escaping in the vicinity of an area upstream from the suction conveyor.

Sixth Aspect

In the sheet conveying device according to the fifth aspect, the plurality of positions at which the guide contacts the uppermost sheet are lower than the height of the surface of the surface guide facing the uppermost sheet. Such a configuration as described above allows the posture of the floated sheet to be maintained while the floated sheet is attracted and conveyed by the pickup belt 6.

Seventh Aspect

In the sheet conveying device according to the sixth aspect, the plurality of positions at which the guide contacts the uppermost sheet are not lower than the height at which the suction conveyor attracts and conveys the uppermost sheet. Such a configuration as described above allows the posture of the uppermost sheet to be maintained while the uppermost sheet is attracted and conveyed, and minimizes the contact resistance.

Eighth Aspect

In the sheet conveying device according to the first aspect, the guide includes a base having a surface facing the uppermost sheet and a surface layer at least on the surface of the base. The surface layer has a smaller friction coefficient with respect to the uppermost sheet than the friction coefficient of the base with respect to the uppermost sheet. Such a configuration as described above allows the range of selection of the base material for the guide to be widened while the contact resistance of the guide with the uppermost sheet is reduced.

Ninth Aspect

An image forming apparatus includes the sheet conveying device according to any one of the first to eighth aspects and an image forming device to form an image on a sheet. The sheet conveying device and the image forming device may be integrated as a single unit or are separate units. Such a configuration as described above can reduce the contact resistance with the sheet and reduce the conveyance load of the sheet as compared with a case in which a guide has a shape such that the guide continuously contacts the sheet in the sheet conveyance direction.

The above-described embodiments are illustrative and do not limit the present disclosure. Thus, numerous additional modifications and variations are possible in light of the above teachings. For example, elements and/or features of different illustrative embodiments may be combined with each other and/or substituted for each other within the scope of the present disclosure.

The invention claimed is:

1. A sheet conveying device comprising:

a sheet stacker configured to stack a plurality of sheets;

an air blower configured to blow air onto the plurality of sheets; and a guide facing an uppermost sheet of the plurality of sheets on the sheet stacker, the guide configured to contact the uppermost sheet at a plurality of positions of the guide spaced apart from each other in a sheet conveyance direction, wherein the guide is an elongated member having a wave shape in which a distance between the guide and the sheet stacker varies in the sheet conveyance direction.

2. The sheet conveying device according to claim 1, further comprising a plurality of guides including arranged at intervals in a direction perpendicular to the sheet conveyance direction, the plurality of guides including the guide.

3. The sheet conveying device according to claim 1, further comprising a suction conveyor configured to suck and convey the uppermost sheet floated by air blown from the air blower, wherein the plurality of positions at which the guide contacts the uppermost sheet are not lower than a height at which the suction conveyor attracts and conveys the uppermost sheet in the sheet conveyance direction.

4. The sheet conveying device according to claim 1, further comprising:

a suction conveyor configured to suck and convey the uppermost sheet floated by air blown from the air blower; and a surface guide between the suction conveyor and the guide in the sheet conveyance direction, the surface guide having a surface facing the uppermost sheet.

5. The sheet conveying device according to claim 4, wherein the plurality of positions at which the guide contacts the uppermost sheet are lower than a height of the surface of the surface guide facing the uppermost sheet.

6. The sheet conveying device according to claim 5, wherein the plurality of positions at which the guide contacts the uppermost sheet are not lower than a height at which the suction conveyor attracts and conveys the uppermost sheet.

7. The sheet conveying device according to claim 1, wherein the guide includes:

a base having a surface facing the uppermost sheet; and a surface layer at least on the surface of the base, and wherein the surface layer has a smaller friction coefficient with respect to the uppermost sheet than the base has.

8. An image forming apparatus comprising:

the sheet conveying device according to claim 1; and an image forming device configured to form an image on a sheet, wherein the sheet conveying device and the image forming device are integrated as a single unit or are separate units.

* * * * *